US006126021A

United States Patent [19]

Wilhite

[11] Patent Number: 6,126,021

[45] **Date of Patent: *Oct. 3, 2000**

[54] ARTICLE STORAGE SYSTEM

[75] Inventor: Gerald Wilhite, Grapevine, Tex.

[73] Assignee: Jokari/US, Inc., Carrollton, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/059,995

[22] Filed: Apr. 13, 1998

[51] Int. Cl.[7] ..... D06F 53/00

[52] U.S. Cl. ..... 211/119.004; 211/113; 211/35; 211/38

[58] Field of Search ..... 211/119.004, 113, 211/118, 35, 36, 38, 34, 32; 248/301; 312/6, 4

[56] References Cited

U.S. PATENT DOCUMENTS

| | | | |
|---|---|---|---|
| D. 197,146 | 12/1963 | Fisher | D58/2 |
| 847,523 | 3/1907 | Stirton | 211/104 |
| 863,121 | 8/1907 | Weaver | 211/38 X |
| 968,977 | 8/1910 | Potter | 211/118 X |
| 1,172,937 | 2/1916 | Butcher | 211/113 X |
| 1,225,607 | 5/1917 | Ford et al. | 211/118 X |
| 1,447,636 | 3/1923 | White | 248/301 |
| 1,752,699 | 4/1930 | Ross | 211/34 X |
| 1,847,066 | 3/1932 | Berg | 211/113 X |
| 2,152,192 | 3/1939 | Hoffman | 211/34 |
| 2,244,887 | 6/1941 | Manley | 312/6 |
| 2,270,796 | 1/1942 | Hauser | 211/35 X |
| 2,359,372 | 10/1944 | Leader | 211/35 X |
| 2,389,910 | 11/1945 | Hoffman | 211/113 X |
| 2,533,333 | 12/1950 | Kitson | 312/6 X |
| 3,116,773 | 1/1964 | Kikas | 383/39 |
| 3,184,273 | 5/1965 | Blough | 312/6 |
| 3,224,640 | 12/1965 | Schneider et al. | 383/40 X |
| 3,314,636 | 4/1967 | McHugh | 211/113 X |
| 3,543,999 | 12/1970 | Kugler | 229/56 |
| 3,669,276 | 6/1972 | Woods | 211/34 |
| 3,746,179 | 7/1973 | Paumgardhen | 211/75 |
| 3,783,995 | 1/1974 | Tobin | 211/113 X |
| 3,809,224 | 5/1974 | Greenwood | 206/219 |
| 3,904,258 | 9/1975 | Faulkenberry | 312/6 |
| 3,907,118 | 9/1975 | Pelavin | 211/113 |
| 4,219,248 | 8/1980 | Goldberg | 211/36 X |
| 4,244,301 | 1/1981 | Nakatsu | 211/113 X |
| 4,327,836 | 5/1982 | Okuno | 211/113 X |
| 4,329,789 | 5/1982 | Erickson | 211/113 X |
| 4,387,873 | 6/1983 | Pavlo et al. | 211/113 X |
| 4,530,168 | 7/1985 | Petre | 211/35 X |
| 4,585,127 | 4/1986 | Benedict | 211/34 |
| 4,709,815 | 12/1987 | Price et al. | 206/387 |
| 4,967,913 | 11/1990 | Bayer | 211/38 |
| 4,974,841 | 12/1990 | Jarriel et al. | 273/1.5 R |
| 4,986,427 | 1/1991 | Law et al. | 211/113 X |
| 5,027,960 | 7/1991 | Rainville | 211/118 |
| 5,125,519 | 6/1992 | Cambria | 211/118 |
| 5,158,186 | 10/1992 | Krut | 211/113 |
| 5,238,301 | 8/1993 | Bradly | 312/328 |
| 5,265,737 | 11/1993 | Freeby | 211/113 X |
| 5,294,007 | 3/1994 | Edmondson | 211/34 |
| 5,396,994 | 3/1995 | Fitzgerald | 211/32 |
| 5,533,534 | 7/1996 | Cariello et al. | 211/35 X |
| 5,542,530 | 8/1996 | Freelander | 211/118 X |
| 5,683,002 | 11/1997 | Rayside | 211/113 X |

*Primary Examiner*—Daniel P. Stodola
*Assistant Examiner*—Khoa Tran
*Attorney, Agent, or Firm*—Gilhooly and Crossman

[57] ABSTRACT

An article storage system capable of being suspended and having two vertical rows of article receiving compartments having side access openings. Lower brackets are affixed to flexible strips to allow the article storage system to be hung under tension in conjunction with upper brackets. Rods are provided adjacent the side access openings to rigidize the article receiving compartments.

12 Claims, 2 Drawing Sheets

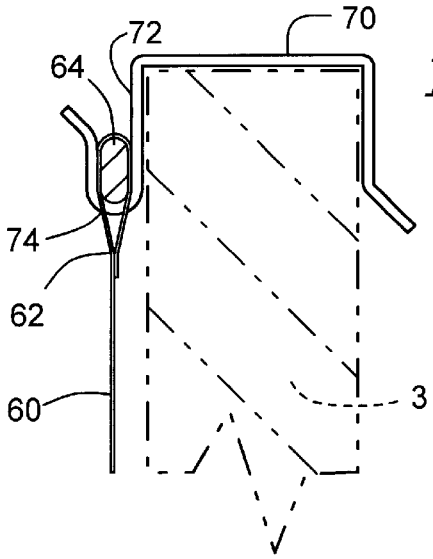
FIG. 3
FIG. 4
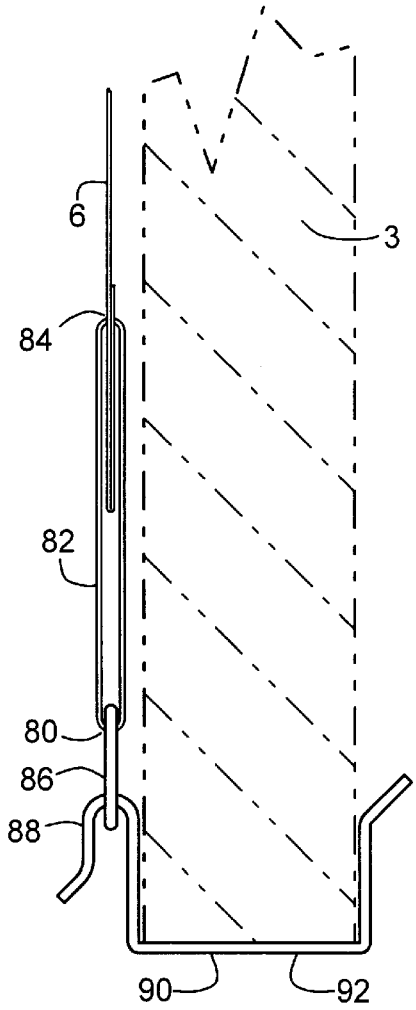
FIG. 5
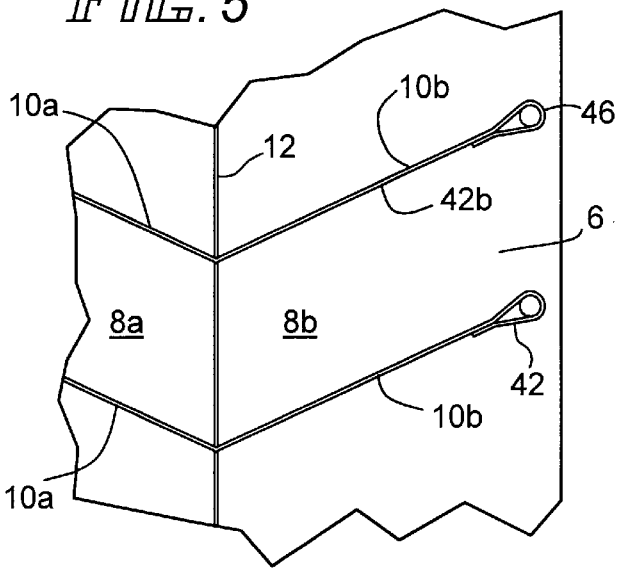
FIG. 6
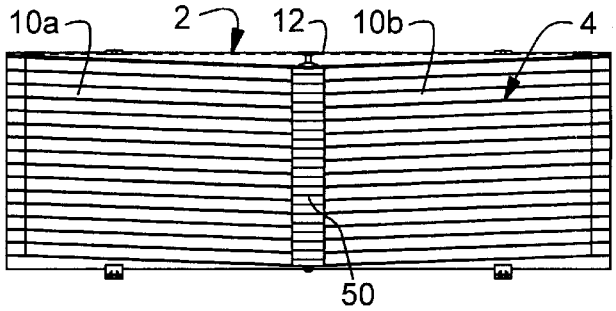

ARTICLE STORAGE SYSTEM

BACKGROUND OF THE INVENTION

1. Field of the Invention

This invention relates to a storage system and, more particularly, to an article storage system for storing items of numerous types in compartments or pockets while hanging on a door and the like.

2. Description of the Prior Art

The availability of adequate storage space for personal clothing articles, sporting goods and household products in the home or elsewhere has long been a persistent problem. Such items are commonly stored in closets, bedrooms, laundries, basements, bathrooms or other locations in the home or elsewhere. Shoes and other items of clothing and accessories, and countless household products require considerable space in a closet or other locale and are difficult to maintain in an organized state. Numerous methods have been developed in the past in an effort to solve the perennial problem of storing such articles. Clothing and other household articles have been stored in bags, in bins or other containers, on shelves, in cupboards, and in other manners. None of the known techniques of article storage have combined the desired objective of creating added storage space with an economical system which can be adjustably attached to a structure, such as a door. Known storage systems are bulky and occupy needed space where positioned and do not provide the high degree of article organization which is desirable. Many known hanging type storage systems also inconveniently require tools and the drilling of holes for installation. In addition, past over the door type storage systems fail to provide needed rigidity to each storage compartment for preventing undesired damage to a stored item. For these reasons, it is desirable in the prior art to provide an improved article storage system capable of effectively and economically storing personal articles and the like while hanging on an existing structure

SUMMARY OF THE INVENTION

It is therefore an objective of the present invention to provide an improved article storage system which can easily be suspended on a door or other suitable vertical structure. In its suspended position, the article storage system herein described creates unique separate storage compartments or pockets which are sloped downward and are accessible from either side of the storage system. Means are provided to rigidize each individual storage compartment in a manner to provide easy access and to prevent undesired damage to contents during support. The article storage system herein is capable of being collapsed for compact transport and storage when not hanging on a door.

Each of the compartments of the article support system herein neatly support one or more articles in an organized and visible manner while hanging on a door or other suitable structure. The article support system is easily hung firmly in place by upper and lower bracket means that require no tools or other fasteners for securement. The lower bracket means is attached to stretchable tension means that allows for adjustable securement to accommodate varying heights of doors and the like and to maintain securement of the article door system in place under tension. The invention is intended to store countless types of articles, such as, for example, personal clothing items like shoes, socks, ties, belts, wallets, purses, hosiery and the like, any household article, such as cans of cleaner, tools and the like, or any sporting goods of suitable size.

BRIEF DESCRIPTION OF THE DRAWINGS

FIG. 3 is a side partial elevational view of the tope bracket of the article storage system of FIG. 1;

FIG. 4 is a partial side elevational view of the lower bracket and tension strip of the article storage system of FIG. 1;

FIG. 5 is a front elevational view taken along lines 5—5 of FIG. 2; and FIG. 6 is a side elevational view of the article storage system of FIG. 1 in a collapsed configuration for transport and storage.

DESCRIPTION OF THE PREFERRED EMBODIMENT

Figure 1:
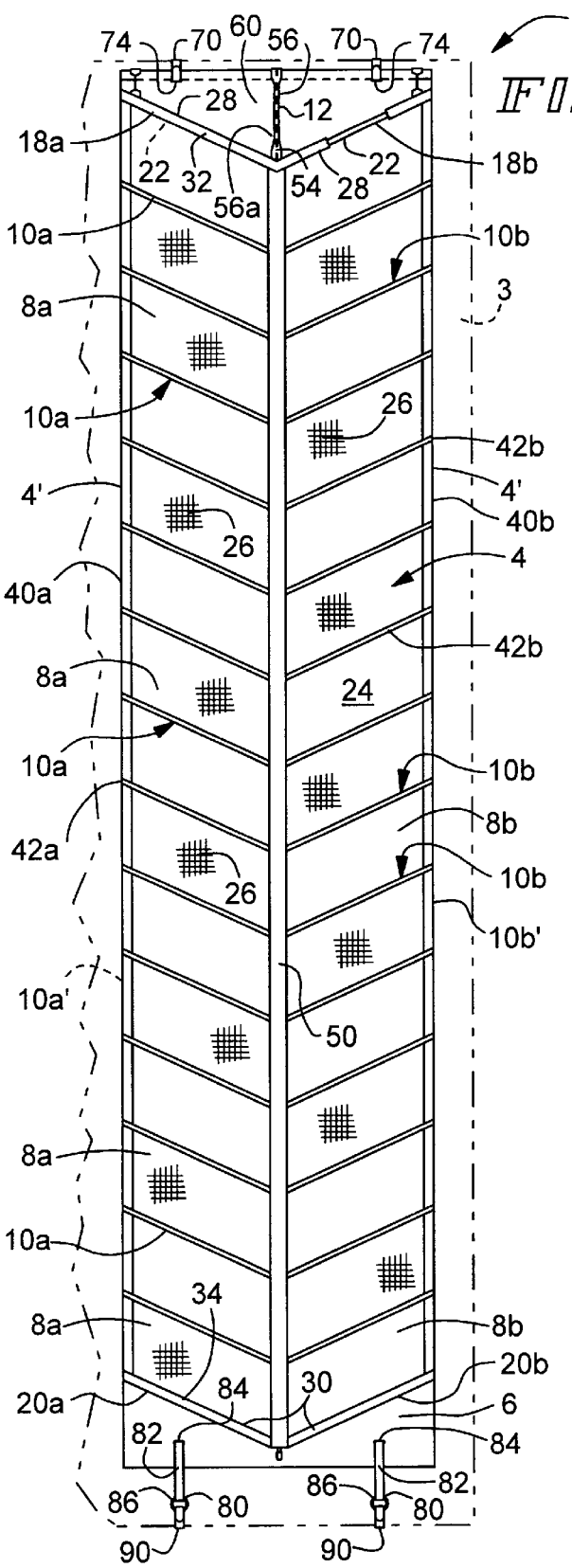
FIG. 1 is a front elevational view, with parts broken away, of the article storage system of the invention.

Referring now to FIGS. 1–5, there is illustrated the article storage system of the invention, generally designated by reference numeral 2, attached in hanging relationship to a door 3 of a closet or other structure. As will be apparent the article storage system 2 is generally collapsible along its vertical axis as shown in FIG. 6 for compact transport and storage when not in use.

Article storage system 2 includes a compartment storage body 4 having a continuous rear flat panel 6 fabricated from a suitable fabric material, such as, for example, nylon and the like. Viewing FIG. 1, a plurality of left side compartments or pockets 8*a* and a plurality of right side compartments or pockets 8*b* are vertically arranged in affixed relationship to back panel 6 in a manner to be described. Although any number of compartments or pockets may be used, dependent on selected dimensions, fifteen compartments or pockets 8*a*, and fifteen compartments 8*b* are illustrated. Each of the left side compartments or panels 8*a* and the right side compartments or pockets 8*b* are separated from an adjacent compartment or pocket respectively by a plurality of spaced rectangular compartment panels 10*a*, 10*b* which are sloped downward from each edge or side 4' of storage body 4. The left side compartments or pockets 8*a* and the right side compartments or pockets 8*b* are separated from each other by a continuous vertical rectangular divider 12 which substantially extends the height of storage body from upper point 14 (FIG. 2) to lower point 16 (FIG. 2) which is reinforced. The sloped compartment panels 10*a*, 10*b* and the divider 12 may each be formed as a single sheet from the same fabric as rear flat panel 6, such as nylon and the like.

A pair of rigid top rectangular panels 18*a*, 18*b* and a pair of bottom rectangular panels 20*a*, 20*b* are of identical size and are sloped in the same manner as compartment panels 10*a*, 10*b* to form respectively the top and bottom panel of the uppermost and lowermost compartment or pocket 8*a*, 8*b*. The uppermost sloped panels 18*a*, 18*b* and lowermost sloped panels 20*a*, 20*b* are identical and are formed from two separate layers of fabric, such as nylon and the like. The two layers of fabric of each of the uppermost sloped panels 18*a*, 18*b* and the lowermost sloped panels 20*a*, 20*b* are sandwiched in stitched relationship over a flat sheet 22 of relatively rigid material such as plastic for strengthening. Through such a construction, uppermost panels 18*a*, 18*b* and lowermost panels 20*a*, 20*b* are more rigid than intermediate sloped panels 10*a*, 10*b*, the latter panels being rigidized in another manner to be described.

A continuous sheet 24 of a fabric mesh, such as nylon and the like, covers the front of each of the compartment or pockets 8*a*, 8*b* and extends continuously from uppermost panels 18*a*, 18*b* to lowermost panels 20*a*, 20*b*. The fabric mesh 24 is formed with a large number of continuous perforations through its surface, such as perforations 26, a portion of which are shown in FIG. 1. The perforations 26 permit a visual inspection of the article(s) within each compartment or pocket 8*a*, 8*b*. The fabric mesh 24 is affixed at its upper edge 28 and lower edge 30 respectively to uppermost panels 18*a* and 18*b* and lowermost panels 20*a*, 20*b* through use of a continuous fabric strips 32, 34. The fabric strips are respectively folded over the front edges of panels 18*a*, 18*b* and panels 20*a*, 20*b*, and the strips, 34, panels 18*a*, 18*b* and fabric mesh 24 are sewn together by a conventional technique. The mesh 24 is also crimped over the front edge portions of sloped compartment panels 10*a* and 10*b* and are sewn together in a conventional manner. A pair of border strengthening strips 40*a*, 40*b* are vertically arranged on both sides of the compartment body 4 and respectively extend from uppermost panels 18*a*, 18*b* to lowermost panels 20*a*, 20*b*. The strengthening strips 40*a*, 40*b* are crimped over a portion of mesh 24 and a front portion of outer edge portions 42*a*, 42*b* of panels 10*a*, 10*b*, the strengthening strips 40*a*, 40*b*, the mesh 24 and outer edge portions 42*a*, 42*b* are thereby stitched together in a conventional manner.

The outer edge portions 42*a*, 42*b* of compartments or pockets 8*a*, 8*b* are further wrapped around a relatively rigid rod 46 (FIG. 5) in a sewn relationship. The rigid rod 46 serves as compartment rigidizing member and generally maintains the horizontal shape of each of the compartments 10*a*, 10*b*. Each of the compartments 10*a*, 10*b* have compartment access openings 10*a*' and 10*b*' adjacent rigid rods 46.

The inner edge portion 48 of the sloped compartment panels 10*a*, 10*b*, 18*a*, 18*b*, and 20*a*, 20*b* (FIG. 2) are folded against back panel 4 and are sewn together. A central strengthening fabric strip 50 extends from uppermost panels 18*a*, 18*b* to lowermost panels 20*a*, 20*b*. Fabric strip 50 is crimped over both a portion of front mesh fabric 24 and a portion of sloped panels 10*a*, 10*b* which elements are all sewn together.

Figure 2:
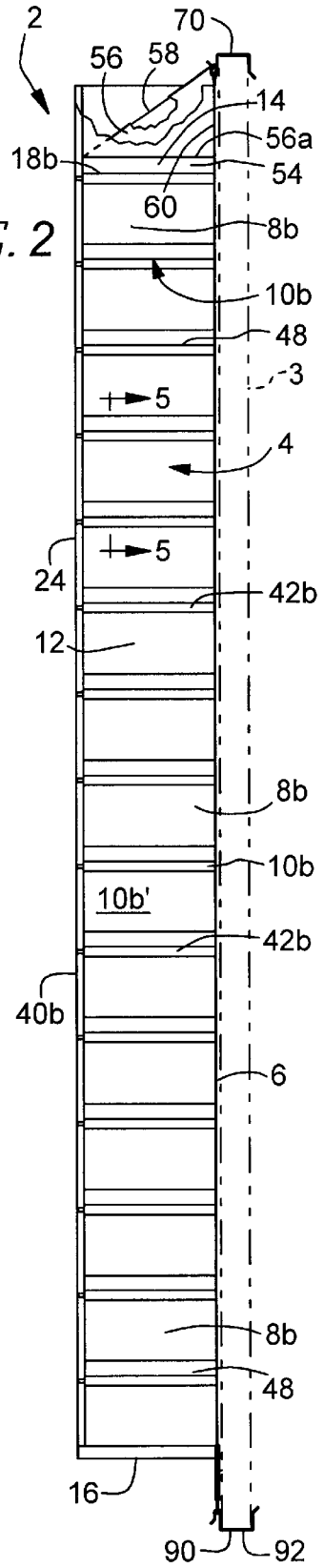
FIG. 2 is an elevational view, with parts broken away, of the article storage system of FIG. 1.

The vertical divider 12 extends upward between uppermost panel 18*a* and 18*b* and possesses an upward projecting strip 54 (FIGS. 1 and 2). A continuous triangular sheet 56 of fabric, such as nylon, and the like, is folded over a flat strengthening member 58 in sandwiched relationship. The bottom edges 56*a* of the sheet 56 are sewn to strip 54 in conventional manner whereas divider 12 is stitched in attached relationship to uppermost panels 18*a* and 18*b*. The upper sheet and strengthening member provides a convenient means for lifting the storage system 2 and otherwise support the structure.

The rear panel 6 extends above uppermost panels 18*a* and 18*b* to form an upper triangular section 60. The upper free edge 62 of triangular section 60 is wrapped around and sewn over an elongated metal strip 64 extending the side of rear panel 6. The metal strip 64 (FIG. 3) strengthens and rigidizes the storage system 2 when suspended for use. The storage system 2 is suspended or hung on a vertical panel, such as a door 3, by a pair of metal brackets 70. Each of the brackets 70 include a front connecting portion 72 for attachment to storage system 2. The storage system connecting portion 72 has a generally U-shaped configuration opening upward which extends through fabric strengthened holes 74 (FIG. 3) in upper triangular section 60 so that the metal strip 64 rests in tight relationship within the generally U-shaped configuration of storage system connecting portion 72. The bracket 70 further is provided with a door securing section 76 which has a generally U-shaped configuration to fit snugly over the top edge of door 3 and the like. The width and shape of section 76 is generally selected to correspond to the expected width and shape of the door on which storage system 2 is to be hung. As should be apparent, the storage system 2 will unfold into the shape shown in FIGS. 1 and 2 due to its weight.

To maintain the storage system 2 in place under tension against door 3, a pair of unique bracket assemblies 80 are used at the bottom of rear panel 6. In bracket assembly 80, a pair of continuous strips 82 of elastic material are looped through open slots 84 provided through the bottom portion of rear panel 6 (FIGS. 1, 2 and 4). The bottom edges of looped elastic strips 82 are sewn together in securement to a ring 86 of metal and the like. A bent back portion 88 of a bottom metal bracket 90 is secured to ring 86. The bracket 90, formed from metal or plastic, has an upwardly opening, generally U-shaped base portion 92 to be secured to the bottom edge of door 3. The lengths of elastic strips 82 are selected to be of an extent to apply resilient forces to brackets 90 under expected heights of door 3. The elastic nature of bracket assembly 80 provides adjustability to allow mounting on doors of a range of heights and maintains the storage system in tension.

In FIG. 6, the storage system 2 is shown in a collapsed configuration for economy of space for transport, packaging and storage. Such an effective collapse is attained because of the flexibility of rear panel 6, divider panel 12, sloped compartment panels 10*a*, 10*b* and the geometric arrangement of strengthening rods 46.

What is claimed is:

1. A storage system for storing articles comprising a body forming an article storage structure arranged to be vertically suspended along a vertical axis, said body having a plurality of downwardly sloped article receiving compartments disposed in a first vertical row and a plurality of downwardly sloped article receiving compartments disposed in second vertical row, said plurality of downwardly sloped compartments of said first vertical row and said plurality of downwardly sloped compartments of said second vertical row being respectively disposed laterally on opposite sides of said vertical axis of said body, each of said article receiving compartments of said first vertical row and said second vertical row respectively having an access opening, said body having a back panel and a front panel for forming said compartments, said body further having a plurality of downwardly sloped spaced panels respectively in said first vertical row and in said second vertical row, said plurality of downwardly sloped panels extending downward from an upper position to a lower position for further forming said plurality of article receiving compartments each of said access openings being created at an uppermost position of each of said sloped article receiving compartments in said first vertical row and said second vertical row between the upper position of adjacent spaced pairs of said plurality of sloped vertical panels in said first vertical row and said second vertical row, said body further having a divider panel affixed to and extending between said back panel and said front panel, said divider panel extending generally along said vertical axis between said first and second rows of said plurality of article receiving compartments for dividing said plurality of article receiving compartments of said first row from said second row and for enclosing said lower position of each of said plurality of article receiving compartments, securement means connected to said body for securing said body to a support member, said back panel, said front panel, and said divider panel being formed from a flexible material to permit said body to be collapsed for storage, and said front panel having means for providing visual access to said plurality of article receiving compartments in said first row and said second row when said body is suspended.

2. The storage system according to claim 1 wherein said body includes a lowermost panel defining the bottom said first row and said second row of said plurality of article receiving compartments and an uppermost panel defining the top of said first row and said second row of said plurality of article receiving compartments.

3. The storage system according to claim 2 wherein an upper portion of said back panel extends above said uppermost panel to form a vertical upper section.

4. The storage system according to claim 3 wherein said upper section of said back panel includes strengthening means having a rigid member affixed to the top edge portion of said upper section of said back panel and extending substantially the width of said body.

5. The storage system according to claim 4 wherein said divider panel includes an upper portion extending upward in connected relationship with said upper section of said back panel for further strengthening of said upper portion of said back panel.

6. The storage system according to claim 5 wherein said upper portion of said divider panel includes a first layer of material folded over a second layer of material of said divider panel, said first and second layer being affixed together.

7. The storage system according to claim 6 further including a continuous vertical strengthening strip of material on said front panel extending along said first axis adjacent said lower positions of said plurality of downwardly sloped panels of said first row and said second row of article receiving compartments, said vertical strip strengthening strip being affixed to said front panel and said plurality of sloped panels at said lower position.

8. The storage system according to claim 4 wherein said securement means is affixed to said rigid member, said securement means including a rigid downwardly opening U-shaped member.

9. The storage system according to claim 2 further including strengthening means for rigidizing said lowermost panel and said uppermost panel, said strengthening means being a flat rigid panel affixed to each of said lowermost panel and said uppermost panel.

10. The storage system according to claim 1 wherein said securement means includes at least a pair of brackets respectively attached to the upper and lower edge portions of a pair of resilient straps that are connecting to said body, said at least a pair of resilient straps respectively acting to secure said body under tension, said at least a pair of resilient straps acting to stretch relative to said body.

11. The storage system according to claim 1 wherein said front panel includes a layer of perforated mesh extending over said pair of vertical rows of article receiving compartments, said layer of perforated mesh providing a visual view within each of said article receiving compartments.

12. The storage system according to claim 1 further comprising stiffening means mounted on said plurality of downwardly sloped panels at said upper position said stiffening means being a rod acting to rigidize the access opening said plurality of article receiving compartments.

* * * * *